United States Patent [19]

Chapell

[11] Patent Number: 4,547,753

[45] Date of Patent: Oct. 15, 1985

[54] MICROWAVE COUPLER

[75] Inventor: Harry F. Chapell, Maynard, Mass.

[73] Assignee: Sage Laboratories, Inc., Natick, Mass.

[21] Appl. No.: 550,774

[22] Filed: Nov. 14, 1983

[51] Int. Cl.[4] ..... H01P 5/18

[52] U.S. Cl. ..... 333/115; 174/102 R; 174/116; 333/243

[58] Field of Search ..... 333/115, 243, 244; 174/102 R, 116

[56] References Cited

U.S. PATENT DOCUMENTS

| | | | |
|---|---|---|---|
| 3,209,064 | 9/1965 | Cutler | 174/116 X |
| 3,358,248 | 12/1967 | Saad | 333/115 |
| 3,566,009 | 2/1971 | Lamond et al. | 174/102 R X |
| 3,567,846 | 3/1971 | Brorein et al. | 174/102 R |
| 3,683,104 | 8/1972 | Woodland et al. | 174/116 |

OTHER PUBLICATIONS

Von Hippel, *Dielectric Materials and Applications,* The MIT Press, Cambridge, Mass., 1954, Title page and pp. 328–330.

*Primary Examiner*—Paul Gensler

*Attorney, Agent, or Firm*—Wolf, Greenfield & Sacks

[57] ABSTRACT

A microwave coupled line device constructed to equalize even and odd mode delay and comprising an outer conductor and first and second inner conductors at least one of which has insulation bonded thereto and separated by the thickness of said insulation therebetween. There is also provided an insulating sleeve disposed in the outer conductor and adapted to accommodate the first and second inner conductors. Means are provided for filling the void between the insulating sleeve and the outer conductor with an insulating material.

15 Claims, 4 Drawing Figures

MICROWAVE COUPLER

BACKGROUND OF THE INVENTION

The present invention relates in general to coupled line devices and is concerned, more particularly, with quadrature hybrids and couplers including directional couplers constructed in accordance with the principals of the present invention and having in particular improved directivity and power handling capabilities. In accordance with the present invention the device has preferred high directivity, low power consumption and high thermal transfer.

U.S. Pat. No. 3,358,248 shows a previous version of a coupled line device including a pair of insulated inner conductors and a common outer conductor with the inner conductors spaced a distance corresponding substantially to a quarter wavelength at the center operating frequency. If the parallel transmission line center conductors could be imbeded in a uniform dielectric material, whether air or some other material, the even and odd mode propagation velocities will be equal. However, in practice this does not occur and in the device described in U.S. Pat. No. 3,358,248, the conductors are not imbeded in a material having a uniform dielectric. For example, the coating on the wires typically has a relatively high dielectric constant which may be in the order of 2.7. In the previous construction which employed a teflan support bead, the support bead has a dielectric constant in the order of 2.0. This inconsistency in dielectric constant slows the odd mode propagation in comparison to the even mode. Also, the wires have a twist which can make the electrical length larger for the odd mode than for the even mode. Furthermore, there tend to be air voids between the wires and the surrounding Teflon. These air voids, depending upon location, may either increase or decrease the odd mode velocity compared to the even mode velocity.

Accordingly, it is an object of the present invention to provide an improved miniaturized coupled line device in which the propagations delay of both the even and odd modes are substantially equalized.

Another object of the present invention is to provide an improved coupler in accordance with the preceding object and which is characterized by high directivity over a wide frequency range.

Another object of the present invention is to provide a coupled line device that may be constructed as a TEM directional coupler and which is characterized by relatively high power handling capabilities.

Another objection of the present invention is to provide a coupled line device that may be constructed as a 3dB hybride in which is characterized by relatively high powered handling capabilities.

Still another object of the present invention is to provide a high performance miniaturized coupled line device that is relatively easy and inexpensive to fabricate.

A further object of the present invention is to provide an improved fabrication technique for a microwave coupler that enables all air voids to be filled thus improving operation and also preventing moisture entry into the device.

Another object of the present invention is to provide an improved microwave coupler device that is constructed to furthermore provide improved center conductor cooling resulting from the filling of air voids.

SUMMARY OF THE INVENTION

To accomplish the foregoing and other objects of this invention there is provided a microwave coupled line device which is operative over a frequency range embracing a predetermined center frequency. This device comprises an outer conductor and first and second inner wire conductors with at least one of the wire conductors having insulation bonded thereto. In constructing the device these inner conductors are separated by the thickness of the insulation therebetween preferably for a distance corresponding substantially to a quarter wavelength at the center frequency and separated by a greater distance elsewhere. There is provided an insulating sleeve disposed in the outer conductor and adapted to accommodate the first and second inner conductors. In order to overcome the aforementioned problems of nonuniform propagation velocities, there is provided for the selective adding of a low loss dielectric constant material preferably having a dielectric constant higher than that of the insulating sleeve. The preferred dielectric constant is 2.9 but may be in a range of 2.6–3.5. The addition of this higher dielectric material preferably disposed between the centerconductors and between the pair of center conductors and the outer conductor, provides for a slowing of the even mode so as to equal the odd mode delay caused by the wire coating and wire twist. This added high dielectric material is preferably provided in a catylist cured liquid form and is injected into the device so as to fill the void between the insulating sleeve which is disposed about the inner conductors, and the inner conductors themselves. Furthermore, the injected material hereinafter also referred to as potting material also fills air voids thereby preventing moisture entry into the device, improves center conductor cooling, and furthermore eliminates the effect that these air voids have upon propagation velocity. There is described herein basically two different shape embodiments including a square version and a round version to be described in further detail hereinafter.

BRIEF DESCRIPTION OF THE DRAWINGS

Numerous other objects, features and advantages of the invention should now become apparent upon reading of the following detailed description taken in conjunction with the accompanying drawing, in which.

DETAILED DESCRIPTION

Figure 1:
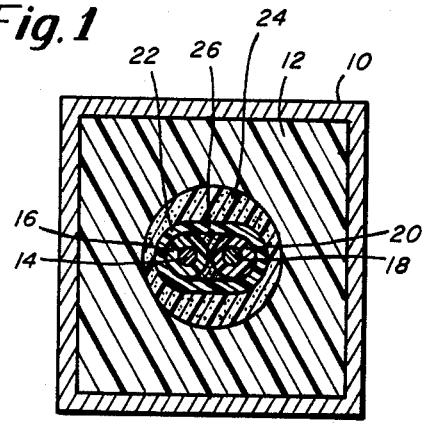
FIG. 1 is a cross-sectional view through the wire line device of the present invention in a first embodiment.

With reference now to the drawing, and more particularly, FIG. 1 thereof, there is shown a cross section view of one embodiment of the invention or which is referred to herein as a square version employing an outer square metallic (such as brass) tubing 10 which has an outer square dimension of 0.25 inch and an inner dimension of 0.222 inch. Disposed within the square metallic tubing 10 is a Teflon block or sleeve 12 having a through passage for receiving the inner conductors. The metallic tubing 10 defines the outer conductor. The sleeve 12 may alternatively be formed of polyolefin.

Within the hollow centrally disposed passage in the Teflon sleeve 12 there are provided inner conductors which includes a first conductor 14 with its associated insulation 16. Similarly, there is a second inner conductor 18 with its associated covering or layer of insulation 20. In the embodiment described in FIG. 1, there is provided a thin wall Mylar or polyester tubing 22 which is used to encapsulate the inner conductors and hold them in relatively fixed spaced interrelationship. It is noted that in the embodiment of FIG. 3 to be described hereinafter the tubing 22 is not used.

In constructing the device of FIG. 1, once the inner conductors are disposed in the tubing 22, then the entire assembly is inserted into the Teflon block 12 and the next step is to then fill the void, particularly the one that exists between the tubing 22 and the Teflon block.

In FIG. 1, as well as the other embodiments described herein, the inner conductors may be copper wire of no. 20 AWG. The insulation on each of wires may be of a type Teflon Kapton. As indicated previously, the tubing 22 may be a heat shrinkable Mylar. The potting material is illustrated in FIG. 1 as filling areas 24 and 26. The area 24 is filled between the tubing 22 and the Teflon sleeve 12. The area 26 is filled about the inner conductors and between the inner conductors and the tubing 22. The potting material may be Sylguard 170 A/B sold by Dow Corning Corporation of Midland, Mich. This is used because of its relatively high dielectic constant and low electrical loss. This is a silicone base which is liquid to which a catalyst is added which causes curing thereof. In the liquid state, the material has low viscosity and thus when injected into the areas disclosed in FIG. 1 fills all voids thus tending to equalize the odd and even mode velocities. This material is also of relatively high dielectric constant on the order of 2.9 particularly in comparison with the dielectric constant of the Teflon sleeve 12 which is on the order of 2.0. The preferred range for dielectric constant is 2.6–3.5 but the range of dielectric constant that is used depends on the dielectric constant of the insulating sleeve and the insulation bonded thereto. By using this higher dielectric constant material there is a decrease of the even mode velocities so as to provide equalization between the even and odd mode propagation velocities. The odd mode velocity is slowed by the Kapton insulation and Mylar insulation. The potting in these voids also fills any air spaces preventing moisture entry and improves the cooling of the center conductors.

Figure 2:
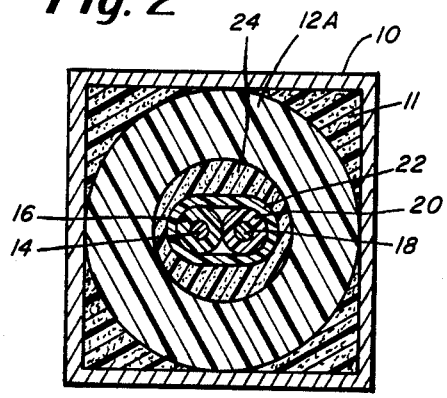
FIG. 2 is a cross-sectional view through an alternate embodiment in which the wire line device is round in construction rather than the square version shown in FIG. 1.

As indicated previously, the embodiment of FIG. 1 is a square version. In FIG. 2 there is provided a round version in that the Teflon sleeve 12*a* is cylindrical. In the embodiment of FIG. 2 the metallic outer conductor 10 may be identical to the tubing used in FIG. 1. However, because the Teflon is cylindrical and the outer conductor is square there is a void area filled with material 11 which may be the aforementioned material Sylguard 170A/B. The other part of the construction of FIG. 2 is substantially the same as shown and previously discussed in connection with FIG. 1. Thus, in the embodiment of FIG. 2 there are provided inner conductors 14 and 18 and insulation 16 and 20 thereon. There is also provided in the embodiment of FIG. 2 the heat shrinkable Mylar tubing 22. The only other difference in the embodiment of FIG. 2 is that the dielectric compensating insulating material Sylguard 170 A/B is only disposed in the outer area between the tubing 22 and the Teflon block. In the embodiment of FIG. 1, this higher dielectric constant material was used in both areas 24 and 26.

Figure 3:
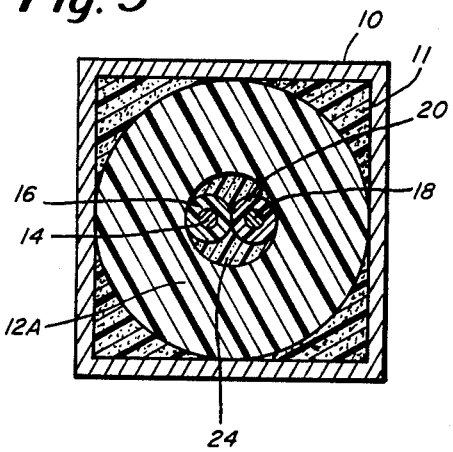
FIG. 3 shows a third alternative embodiment of the invention in a cross-sectional view similar to the view of FIG. 2 but with the supporting sleeve removed.

A further embodiment of the present invention is illustrated in FIG. 3. In FIG. 3 the same reference characters have been used to identify the same parts as previously described in FIGS. 1 and 2. The embodiment of FIG. 3 is constructed without the use of the heat shrinkable Mylar tubing 22. In this case the inner conductors with their attached insulation join together and are essentially force fitted into the opening in the Teflon sleeve 12*a*. Thus, in this embodiment the open passage in the Teflon sleeve may be made smaller so that there is an appropriate force fit and it is this force fit of the inner conductors into the Teflon sleeve that maintains their alignment. Once aligned in the Teflon sleeve, then the higher dielectric constant material is injected into the void area between the inner conductors and the Teflon sleeve, as well as between outer conductors 10 and insulating sleeve 12A.

In an alternate embodiment, the outer conductor 10 may be of circular cross section. Potting material 11 will fill any small voids between circular conductor 10 and round insulatng sleeve 12A.

Figure 4:
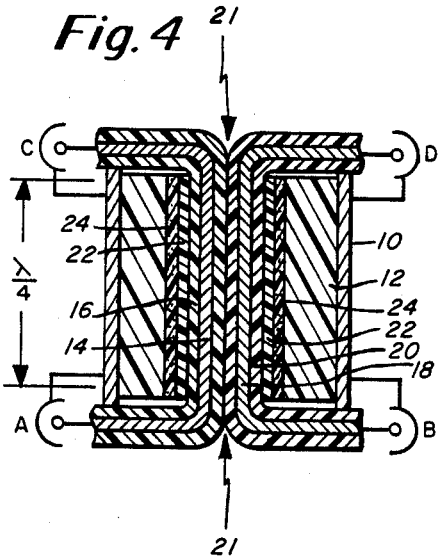
FIG. 4 is a longitudinal sectional view of the embodiment of FIG. 1 showing the manner in which the wire line is arranged to form a directional coupler device.

FIG. 4 is a longitudinal sectional view showing the wire line construction of the present invention as embodied in a coupler device in which there are provided four terminal pairs A, B, C and D. When these terminal pairs are terminated in their respective characteristic impedances, energy applied to one terminal pair divides between the nearest two terminal pairs while negligible energy is delivered to the farthest terminal pair. Thus, energy applied to terminal pair A divides between terminal pairs B and C in phase quadrature while actually no energy is delivered to terminal pair D. Conductor 14 intercouples signal terminal A and signal terminal C. Conductor 18 intercouples signal terminal B and signal terminal D as indicated previously. Thin layers of insulation 16 and 20 are bonded to conductors 14 and 18 respectively. These insulated portions are in contact along the line 21 for a quarter wavelength at the center frequency so that the conductors 14 and 18 are separated by the insulation thickness.

The concepts of the present invention provide improved directivity and power handling capabilities. The devices that are constructed are suitable for operation over, for example, octave bandwidths in the 150 MHz to 2 GHZ band. The couplers are suitable for narrow band operation for frequencies well beyond 2 GHz. The devices are available in either 0.25 square inch or 0.25 inch round cross-sections. Usually, in the embodiment of FIG. 4, the apparatus is provided without end walls and with a metal sleeve ending at the conductor insulation. In this arrangement the end user then provides the 50 ohm line from that point usable in any transmission line configuration such as in microstrip, strip line or coax.

As a hybrid or coupler, the devices offer an VSWR of 1.1 or less, an isolation greater than 30 dB and a power rating of 500 watts at 1 GHz. Typically, a square cross section hybrid, 2.38 inches long, operates over a frequency range of 750 to 950 MHz and weighs less than 0.5 ounces.

When used as a directional coupler, the device displays equally good performance over a narrower band. Typically, a square cross section, 20 dB directional coupler, 1.30 inches long, operates over a frequency range of 88 to 108 MHz and weighs less than 0.5 ounces.

A principal application of devices of the present invention is in printed circuit work, where it is inconvenient to achieve either high power quadrature hybrid or direction coupler performance using planar techniques. The exterior of the unit is tin plated for ease in soft soldering and epoxy bonding. The wires are cut and trimmed to simplify assembly.

In an octave bandwidth version of the invention there is provided for quarter wave coupling (excluding losses) at mid band of 2.70 dB±0.15 dB. In addition, a narrow band version is available for frequency bandwidths less than 30% with mid band coupling (excluding losses) of 3.0 dB±0.15 dB. The modules are supplied cut to length. The length of a hybrid in inches is determined by dividing 1.97 by the center frequency in GHz.

Having now described a limited number of embodiments of the present invention, it should now be apparent to those skilled in the art that numerous other embodiments are contemplated as falling within the scope of the present invention as defined by the appended claims.

What is claimed is:

1. A microwave coupled line device operated over a frequency range having a predetermined center frequency and comprising:

means defining an outer conductor, first and second inner conductors at least one of which has insulation bonded thereto and separated by the thickness of said insulation there between, an insulating sleeve disposed in said outer conductor and adapted to accommodate said first and second inner conductors, a means for filling the void between the insulating sleeve and the inner conductors with an insulating material having a relatively high dielectric constant particularly in comparison with the dielectric constant of the insulating sleeve and in the range of a dielectric constant of 2.6–3.5, the means for filling having a dielectric constant selected in comparison with the dielectric constant of the insulating sleeve so as to decrease the even mode velocities so as to approach equalization between the even and odd mode propagation velocities.

2. A microwave coupled line device as set forth in claim 1 wherein said first and second inner conductors each have an insulation layer thereon.

3. A microwave coupled line device as set forth in claim 1 wherein said first and second inner conductors are separated by said insulation there between for a distance corresponding substantially to a quarter wave length at said predetermined center frequency and separated by a greater distance elsewhere.

4. A microwave coupled line device as set forth in claim 3 wherein said insulating sleeve is of a Teflon material.

5. A microwave coupled line device as set forth in claim 4 wherein said outer conductor is a metal tube.

6. A microwave coupled line device as set forth in claim 1 further including a polyester sleeve disposed between said insulating sleeve and inner conductors and adapted to encase said inner conductors.

7. A microwave coupled line device as set forth in claim 1 wherein said means for filling has a dielectric constant on the order of 2.9 and greater than the dielectric constant of the insulating sleeve.

8. A microwave coupled line device as set forth in claim 7 wherein said inner conductors each include a copper wire.

9. A microwave coupled line device as set forth in claim 1 wherein said insulating sleeve is square.

10. A microwave coupled line device as set forth in claim 1 wherein said insulating sleeve is round.

11. A microwave transmission line apparatus comprising:

means defining an outer conductor, first and second inner conductors at least one of which has insulation bonded thereto and separated by the thickness of said insulation there between, an insulating sleeve disposed in said outer conductor and adapted to accommodate said first and second inner conductors, a means for filling the void between the insulating sleeve and the inner conductors with an insulating material having a relatively high dielectric constant particularly in comparison with the dielectric constant of the insulating sleeve, the means for filling having a dielectric constant selected in comparison with the dielectric constant of the insulating sleeve so as to decrease the even mode velocities so as to approach equalization between the even and odd mode propagation velocities.

12. A microwave transmission line apparatus as set forth in claim 11 wherein the dielectric constant of the insulating material is in the range of 2.6–3.5.

13. A microwave transmission line apparatus as set forth in claim 11 further including a polyester sleeve disposed between said insulating sleeve and inner conductors and adapted to encase said inner conductors.

14. A microwave transmission line apparatus as set forth in claim 11 further including a polyolefin sleeve disposed between said insulating sleeve and inner conductors and adapted to encase said inner conductors.

15. A method of constructing a microwave coupled line device comprising the steps of:

providing an outer conductor, providing first and second inner conductors, at least one of which has insulation bonded thereto and providing a separation between the inner and outer conductors defined primarily by this insulation, providing an insulating sleeve disposed in the outer conductor and for accommodating the first and second inner conductors, and filling the void between the insulating sleeve and the inner conductors with an insulating material having a dielectric constant in the range of 2.6–3.5, selecting the insulating material for filling with a dielectric constant in comparison with the dielectric constant of the insulating sleeve so as to decrease the even mode velocities so as to approach equalization between the even and odd mode propagation velocities.

* * * * *